US008573449B2

(12) United States Patent
Neuhaus et al.

(10) Patent No.: US 8,573,449 B2
(45) Date of Patent: Nov. 5, 2013

(54) DISPENSING DEVICE HAVING AN ELASTICALLY DEFORMABLE SECTION FOR PUMPING A FLUID

(75) Inventors: Reinhard Neuhaus, Hemer (DE); Reiker Canfield, Crystal Lake, IL (US); Jacques Achille Blanie, Unna (DE)

(73) Assignee: Aptar Dortmund GmbH, Dortmund (DE)

( * ) Notice: Subject to any disclaimer, the term of this patent is extended or adjusted under 35 U.S.C. 154(b) by 312 days.

(21) Appl. No.: 12/303,807

(22) PCT Filed: Jun. 6, 2007

(86) PCT No.: PCT/EP2007/004995

§ 371 (c)(1),
(2), (4) Date: Apr. 1, 2010

(87) PCT Pub. No.: WO2007/140995

PCT Pub. Date: Dec. 13, 2007

(65) Prior Publication Data

US 2010/0252577 A1 Oct. 7, 2010

(30) Foreign Application Priority Data

Jun. 8, 2006 (DE) ..... 10 2006 027 042

(51) Int. Cl.
*B65D 37/00* (2006.01)

(52) U.S. Cl.
USPC ..... 222/207; 222/212; 222/383.1

(58) Field of Classification Search
USPC ..... 222/207, 211–214, 383.1, 385, 222/320–321.9
See application file for complete search history.

(56) References Cited

U.S. PATENT DOCUMENTS

| | | | | |
|---|---|---|---|---|
| 2,500,687 | A | | 3/1950 | Kamp et al. |
| 2,679,337 | A | * | 5/1954 | Leach ..... 222/209 |
| 2,714,475 | A | | 8/1955 | Roehrich |
| 2,721,010 | A | | 10/1955 | Meshberg |
| 2,736,930 | A | | 3/1956 | Longley |
| 2,772,817 | A | | 12/1956 | Jauch |
| 2,812,884 | A | | 11/1957 | Ward |

(Continued)

FOREIGN PATENT DOCUMENTS

| | | |
|---|---|---|
| DE | 2043415 | 9/1970 |
| DE | 2920497 | 11/1980 |

(Continued)

OTHER PUBLICATIONS

Wacker Silicones, Geniomer® 200 Thermoplastic Silicone Elastomer, Jan. 10, 2005, XP002394023, retrieved from Internet address http://www.wacker.com/internet/webcache/en_US?PTM?TM?GENIOMER/GENIOMER_200_e.pdf on Aug. 8, 2006.

(Continued)

*Primary Examiner* — Frederick C Nicolas
*Assistant Examiner* — Patrick M Buechner
(74) *Attorney, Agent, or Firm* — Jason H. Vick; Sheridan Ross, PC

(57) ABSTRACT

A dispensing device for dispensing a preferably cosmetic fluid is proposed. The dispensing device has an elastically deformable section for pumping a fluid. Simple and easy actuation is made possible by the section having a concave region in the initial position and/or by the thickness of the section varying.

20 Claims, 3 Drawing Sheets

(56) References Cited

U.S. PATENT DOCUMENTS

| | | | | |
|---|---|---|---|---|
| 2,837,249 | A | 6/1958 | Meshberg | |
| 2,884,164 | A | 4/1959 | Kleid | |
| 2,980,301 | A | 4/1961 | Gorter | |
| 3,018,928 | A | 1/1962 | Meshberg | |
| 3,073,489 | A | 1/1963 | Friedman | |
| 3,104,785 | A | 9/1963 | Beard, Jr. | |
| 3,131,834 | A | 5/1964 | Meshberg | |
| 3,162,333 | A | 12/1964 | Davidson | |
| 3,258,369 | A | 6/1966 | Blaich | |
| 3,385,482 | A | 5/1968 | Frangos | |
| 3,507,586 | A | 4/1970 | Gronemeyer et al. | |
| 3,511,418 | A | 5/1970 | Venus, Jr. | |
| 3,542,253 | A | 11/1970 | Weber et al. | |
| 3,608,830 | A | 9/1971 | Ramella | |
| 3,672,543 | A | 6/1972 | Roper et al. | |
| 3,698,961 | A | 10/1972 | Niemann | |
| 3,706,393 | A | 12/1972 | Curtis et al. | |
| 3,726,442 | A | 4/1973 | Davidson et al. | |
| 3,795,350 | A | 3/1974 | Shay | |
| 3,796,356 | A | 3/1974 | Venus, Jr. | |
| 3,931,831 | A | 1/1976 | French | |
| 3,961,725 | A | 6/1976 | Clark | |
| 3,991,916 | A | 11/1976 | Del Bon | |
| 4,035,303 | A | 7/1977 | Ufferfilge | |
| 4,099,651 | A | 7/1978 | Von Winckelmann | |
| 4,222,501 | A | 9/1980 | Hammett et al. | |
| 4,282,986 | A * | 8/1981 | af Ekenstam et al. | 222/1 |
| 4,304,749 | A | 12/1981 | Bauer | |
| 4,352,443 | A | 10/1982 | Libit | |
| 4,387,833 | A | 6/1983 | Venus, Jr. | |
| 4,416,602 | A | 11/1983 | Neumeister | |
| 4,423,829 | A | 1/1984 | Katz | |
| 4,458,832 | A | 7/1984 | Corsette | |
| 4,561,571 | A | 12/1985 | Chen | |
| 4,564,130 | A | 1/1986 | Eulenburg | |
| 4,651,904 | A | 3/1987 | Schuckmann | |
| 4,798,313 | A | 1/1989 | Farley | |
| 4,830,229 | A | 5/1989 | Ball | |
| 4,867,347 | A | 9/1989 | Wass et al. | |
| 4,875,604 | A | 10/1989 | Czech | |
| 4,892,231 | A | 1/1990 | Ball | |
| 4,919,312 | A | 4/1990 | Beard et al. | |
| 4,964,852 | A | 10/1990 | Dunning et al. | |
| 4,969,577 | A | 11/1990 | Werding | |
| 5,007,556 | A | 4/1991 | Lover | |
| 5,007,596 | A | 4/1991 | Iwahashi | |
| 5,096,098 | A | 3/1992 | Garcia | |
| 5,197,637 | A | 3/1993 | Naumann | |
| 5,221,724 | A | 6/1993 | Li et al. | |
| 5,271,432 | A | 12/1993 | Gueret | |
| 5,301,850 | A | 4/1994 | Gueret | |
| 5,360,145 | A | 11/1994 | Gueret | |
| 5,413,250 | A | 5/1995 | Gueret | |
| 5,454,488 | A | 10/1995 | Geier | |
| 5,465,872 | A | 11/1995 | Gueret | |
| 5,492,252 | A | 2/1996 | Gueret | |
| 5,505,341 | A | 4/1996 | Gueret | |
| 5,509,582 | A | 4/1996 | Robbins, III | |
| 5,603,434 | A * | 2/1997 | von Schuckmann | 222/207 |
| 5,687,884 | A | 11/1997 | Bodin et al. | |
| 5,728,333 | A | 3/1998 | Tabata et al. | |
| 5,732,855 | A | 3/1998 | Van der Heijden | |
| 5,738,251 | A * | 4/1998 | Schuckmann | 222/207 |
| 5,743,441 | A | 4/1998 | Baudin et al. | |
| 5,769,283 | A | 6/1998 | Owada et al. | |
| 5,779,108 | A | 7/1998 | Barriac et al. | |
| 5,857,224 | A | 1/1999 | Oberg et al. | |
| 5,862,955 | A | 1/1999 | Albini et al. | |
| 5,868,287 | A | 2/1999 | Kurolkawa et al. | |
| 5,873,491 | A | 2/1999 | Garcia et al. | |
| 5,875,936 | A | 3/1999 | Turbett et al. | |
| 5,875,939 | A | 3/1999 | Geier | |
| 5,881,929 | A | 3/1999 | Coerver, Jr. | |
| 5,927,568 | A | 7/1999 | De Nervo et al. | |
| 5,975,381 | A | 11/1999 | Revenu | |
| 6,007,914 | A | 12/1999 | Joseph et al. | |
| 6,083,450 | A | 7/2000 | Safian | |
| 6,112,953 | A | 9/2000 | Gueret | |
| 6,116,475 | A | 9/2000 | Delage | |
| 6,145,707 | A | 11/2000 | Baudin | |
| 6,216,916 | B1 | 4/2001 | Maddox et al. | |
| 6,244,473 | B1 * | 6/2001 | Keung et al. | 222/207 |
| 6,298,960 | B1 | 10/2001 | Derr | |
| 6,322,542 | B1 | 11/2001 | Nilson et al. | |
| 6,328,920 | B1 | 12/2001 | Uchiyama et al. | |
| 6,341,717 | B2 | 1/2002 | Auer | |
| 6,352,184 | B1 | 3/2002 | Stern et al. | |
| 6,589,216 | B1 | 7/2003 | Abbott et al. | |
| 6,629,799 | B2 | 10/2003 | Flores, Jr. | |
| 6,756,004 | B2 | 6/2004 | Davis et al. | |
| 6,778,089 | B2 | 8/2004 | Yoakum | |
| 6,832,704 | B2 | 12/2004 | Smith | |
| 6,919,114 | B1 | 7/2005 | Darras et al. | |
| 6,966,465 | B2 | 11/2005 | Kang | |
| 7,264,142 | B2 | 9/2007 | Py | |
| 7,780,045 | B2 | 8/2010 | Rossignol | |
| 7,854,355 | B2 | 12/2010 | Rossignol | |
| 8,225,966 | B2 * | 7/2012 | Canfield et al. | 222/207 |
| 8,240,518 | B2 * | 8/2012 | Canfield | 222/207 |
| 8,365,962 | B2 * | 2/2013 | Canfield | 222/153.13 |
| 2002/0037179 | A1 | 3/2002 | Suzuki et al. | |
| 2002/0051314 | A1 | 5/2002 | Hayashi | |
| 2002/0074355 | A1 | 6/2002 | Lewis et al. | |
| 2002/0190085 | A1 | 12/2002 | Stanford | |
| 2003/0071080 | A1 | 4/2003 | Yquel | |
| 2003/0230603 | A1 | 12/2003 | Smith | |
| 2005/0155980 | A1 | 7/2005 | Neuhalfen | |
| 2006/0060618 | A1 | 3/2006 | Hoepner et al. | |
| 2006/0113318 | A1 | 6/2006 | May et al. | |
| 2006/0231519 | A1 | 10/2006 | Py et al. | |
| 2006/0261093 | A1 * | 11/2006 | Laidler et al. | 222/207 |
| 2007/0080177 | A1 * | 4/2007 | Hatton et al. | 222/207 |
| 2007/0164052 | A1 * | 7/2007 | Julian Pidevall et al. | 222/207 |
| 2007/0228082 | A1 | 10/2007 | Jasper et al. | |
| 2007/0272767 | A1 | 11/2007 | Niggemann | |
| 2008/0110941 | A1 | 5/2008 | Foster et al. | |
| 2008/0197152 | A1 | 8/2008 | Neuhaus et al. | |
| 2009/0166383 | A1 | 7/2009 | Canfield | |
| 2009/0173751 | A1 * | 7/2009 | Laidler et al. | 222/207 |
| 2009/0212075 | A1 | 8/2009 | Neuhaus et al. | |
| 2009/0294480 | A1 | 12/2009 | Canfield | |
| 2009/0314810 | A1 | 12/2009 | Neuhaus | |
| 2010/0012680 | A1 | 1/2010 | Canfield et al. | |
| 2010/0038385 | A1 | 2/2010 | Jasper | |
| 2010/0108722 | A1 | 5/2010 | Canfield et al. | |
| 2010/0147898 | A1 | 6/2010 | Blumenstein et al. | |
| 2010/0206911 | A1 | 8/2010 | Bernhard | |
| 2010/0308077 | A1 | 12/2010 | Sonntag | |

FOREIGN PATENT DOCUMENTS

| | | |
|---|---|---|
| DE | 9307083 | 7/1993 |
| DE | 4210225 | 9/1993 |
| DE | 19851659 | 11/1998 |
| DE | 29820894 | 1/1999 |
| DE | 19744510 | 4/1999 |
| DE | 19832824 | 2/2000 |
| DE | 19950512 | 5/2001 |
| DE | 20203841 | 6/2002 |
| DE | 10308727 | 6/2004 |
| DE | 202004011219 | 11/2004 |
| DE | 202004011220 | 11/2004 |
| DE | 20200512684 | 11/2005 |
| EP | 0058700 | 9/1982 |
| EP | 0069738 | 1/1983 |
| EP | 0179538 | 4/1986 |
| EP | 0320510 | 6/1989 |
| EP | 0442858 | 8/1991 |
| EP | 0599301 | 6/1994 |
| EP | 0864371 | 9/1998 |
| EP | 0893356 | 1/1999 |
| EP | 0908395 | 4/1999 |
| EP | 0930102 | 7/1999 |
| EP | 1084669 | 3/2001 |

(56) References Cited

FOREIGN PATENT DOCUMENTS

| | | | |
|---|---|---|---|
| EP | 1327478 | | 7/2003 |
| EP | 1637232 | | 3/2006 |
| FR | 1266391 | | 7/1961 |
| FR | 2127774 | A | 10/1972 |
| FR | 2510069 | A | 1/1983 |
| FR | 2654079 | | 11/1983 |
| FR | 2600722 | | 12/1987 |
| FR | 2783667 | | 3/2000 |
| FR | 2838108 | | 10/2003 |
| GB | 1405546 | | 8/1972 |
| GB | 1523732 | | 9/1978 |
| GB | 2083142 | | 3/1982 |
| GB | 2105729 | | 3/1983 |
| GB | 2150226 | A | 6/1985 |
| GB | 2155435 | | 9/1985 |
| GB | 2161222 | A | 1/1986 |
| JP | 06191596 | | 7/1994 |
| JP | 07251884 | | 3/1995 |
| JP | 09039467 | | 2/1997 |
| WO | WO 96/16746 | | 6/1996 |
| WO | WO 00/26007 | | 5/2000 |
| WO | WO 00/44505 | | 8/2000 |
| WO | WO 01/25116 | | 4/2001 |
| WO | WO 02/079679 | | 10/2002 |
| WO | WO 2004/022143 | | 3/2004 |
| WO | WO 2004/073871 | | 9/2004 |
| WO | WO 2004/073877 | | 9/2004 |
| WO | WO 2004073878 | A2 * | 9/2004 ..... B05B 11/00 |
| WO | WO2005/000731 | A | 1/2005 |
| WO | WO 2005/123542 | | 12/2005 |
| WO | WO 2005/123543 | | 12/2005 |
| WO | WO2006/123168 | A | 11/2006 |
| WO | WO 2006/128574 | | 12/2006 |
| WO | WO 2007/062824 | | 6/2007 |
| WO | WO 2007/104561 | | 9/2007 |
| WO | WO 2009/030393 | | 3/2009 |

OTHER PUBLICATIONS

Written Opinion prepared by the European Patent Office on Aug. 12, 2008, (with English translation) for International Application No. PCT/EP2007/004995.

International Preliminary Report on Patentability issued by the European Patent Office on Jan. 13, 2009, (with English translation) for International Application No. PCT/EP2007/004995.

International Search Report prepared by the European Patent Office on Nov. 15, 2007, for International Application No. PCT/EP2007/004995; Applicant, Seaquist Perfect Dispensing GMBH.

* cited by examiner

DISPENSING DEVICE HAVING AN ELASTICALLY DEFORMABLE SECTION FOR PUMPING A FLUID

CROSS REFERENCE TO RELATED APPLICATIONS

This application is a national stage application under 35 U.S.C. 371 of PCT Application No. PCT/EP2007/004995 having an international filing date of 6 Jun. 2007, which designated the United States, which PCT application claimed the benefit of Germany Application No. 10 2006 027 042.8 filed 8 Jun. 2006, the entire disclosures of each are hereby incorporated herein by reference.

The invention relates to a dispensing device as set forth in the preamble of one of the independent claims.

In the present invention, the term "dispensing device" is to be particularly understood as a dosing pump or hand-operated pump for the dispensing of a preferably cosmetic liquid. However, it can also be any other dispensing device such as a container, dispensing or spray head, dispenser or the like, particularly for a cosmetic liquid.

The term "cosmetic liquid" is to be understood, in a narrower sense, as cosmetics, hair spray, hair lacquer, a deodorant, a foam, a gel, a color spray, a sun protection or skin care agent or the like. Preferably, however, in a broader sense, other body care products, cleaning products or the like, and even suspensions and fluids, particularly those with gas phases, are included as well. Moreover, other liquids, for example air improvers and particularly technical liquids and fluids as well such as rust removers and the like, can also be used. Nonetheless, for the sake of simplicity and due to the emphasized use, there is often only mention of cosmetic liquid in the following.

Dispensing devices with a lower part and an elastic upper part are known. The upper part forms a pump chamber together with the lower part. By pressing down on the upper part by means of an actuation element, a liquid can be forced and dispensed from the pump chamber. Subsequently, an automatic elastic restoration of the upper part into its previous place occurs, with new liquid being sucked into the pump chamber.

It is the object of the present invention to propose an improved dispensing device with which simple and easy actuation—preferably even upon nearly complete emptying of the pump chamber or low dead volume—can be achieved, particularly even with a highly viscous cosmetic liquid.

The above object is achieved by a dispensing device according to the claims appended hereto. Advantageous modifications are the object of the subclaims.

One aspect of the present invention consists in that the elastically deformable or flexible section bordering on the pump chamber or fluidly connected therewith has a concave, particularly preformed area in the initial position or in the unloaded state on or into which an associated actuation element acts or engages. This permits a simpler deformation of the section and reduces, in particular, the initial force for the deformation of the section.

In its deformed state in radial section, the concave area preferably has turning points on a diameter with spacing which is particularly less than 70% of the diameter—lying on this sectional plane—of the associated pump chamber. This is also conducive to a simple actuation of the section.

Another aspect of the present invention consists in providing the elastically deformable or flexible section with a flat, particularly level area which is acted upon in order to deform the section, that is, to pump the liquid. This allows for an optimized pumping behavior, particularly a uniform or very quick increase in pressure such as is required or desired especially preferably for the spraying of the liquid.

According to another aspect of the present invention, the force of the deformation of the section—particularly the initial force of the deformation of the section—is less than 50 N, preferably less than 30 N, particularly less than 20 N.

According to another aspect of the present invention, the thickness of the section varies. This allows for an optimal structuring of the section to achieve the desired deformation characteristics.

According to another aspect of the present invention, the diameter of the actuation element—particularly the diameter of an end of the actuation element acting on the section—is less than 50% of the diameter of the pump chamber. This is conducive to simple actuation.

According to another aspect of the present invention, the actuation element and the section are embodied such that the section fills out more the pump chamber to greater than 70%, preferably greater than 90%, particularly greater than 95% in the deformed state.

According to another aspect of the present invention consists in that the end of the actuation element acting on the section and a bottom on the side facing away from the actuation element are embodied at least substantially complementarily to each other. This is conducive to simple actuation when in an almost completely empty state, since a special deformation or pretensioning with commensurately strong forces is not required to largely empty the pump chamber.

Another aspect of the present invention consists in tapering the actuation element toward the free end. This, too, is conducive to simple actuation.

Other advantages, features, characteristics and aspects of the present invention follow from the claims and the following description of preferred embodiments on the basis of the drawing.

DETAILED DESCRIPTION

In the figures, the same reference symbols are used for same or similar components, with commensurate or comparable characteristics or features being achieved even if a repeated description is omitted.

Figure 1:
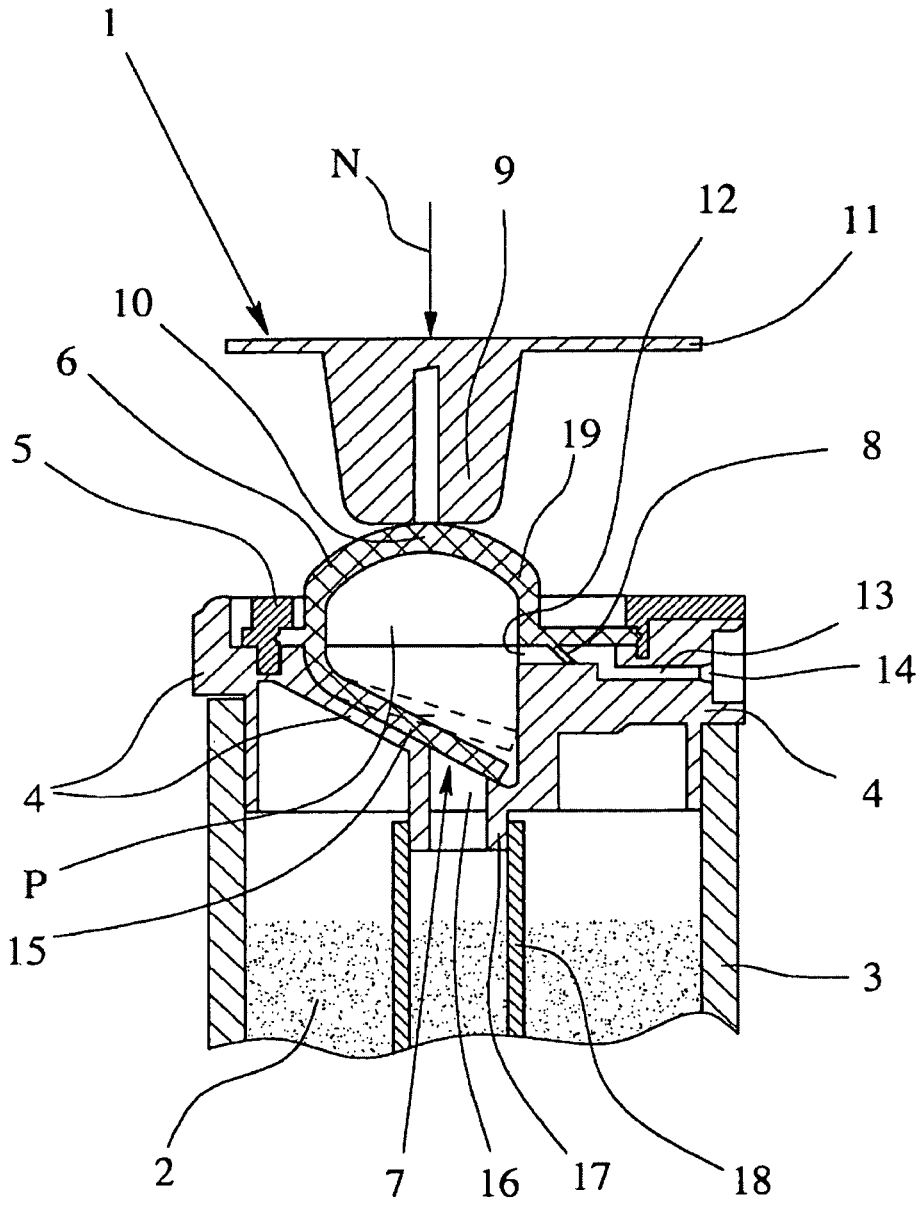
FIG. 1 shows a schematic section of a proposed dispensing device according to a first embodiment.

FIG. 1 shows a proposed dispensing device 1 for dispensing a preferably cosmetic liquid 2 in the sense named at the outset. The liquid 2 can be substantially more viscous than water or, optionally, even be pasty.

Preferably associated with the dispensing device 1 is a bag or container 3 for supplying the liquid 2 with which the dispensing device 1 is detachably connected as needed, or vice versa. For instance, the bag, container 3, or the like can be changed out and/or the liquid 2 refilled. Alternatively, the dispensing device 1 can also form a reservoir for the liquid 2 or the container itself.

The dispensing device 1 preferably has a first component 4, particularly a lower part, and a second component 5. The second component 5 is preferably connected or connectable with the first component 4 in a non-detachable, liquid-tight and, particularly, gas-tight manner.

The first and/or second component 4, 5 is preferably rigid and/or embodied in a single piece, and is particularly injection molded or manufactured in another manner from a suitable, preferably food-safe plastic, particularly a polyolefin, such as PP (polypropylene) or PE (polyethylene).

The second component 5 is preferably used to affix or hold a further component, particularly an upper part or elastically deformable part or section 6. Especially preferably, the section 6 is formed by the second component 5 or formed thereon or vice versa. Preferably, the section 6 is at least substantially dome-like, spherical and/or convex as indicated in FIG. 1.

In particular, the section 6 can be at least substantially rotationally symmetrical with respect to a direction of deformation or actuation N.

In the depicted example, the second component 5 is preferably injection-molded onto the section 6 or connected non-detachably and liquid-tightly therewith in another manner. This makes simple manufacture possible, for example by means of so-called "bi-injection," i.e. particularly by means of the injection molding of another material in the same injection mold in which a first material is formed. Particularly, a chemical and/or mechanical connection is thus made possible.

Alternatively or in addition, the second component 5 can also be connected or held together with the section 6 by means of an undercut, recess, through hole, overlap, or the like. However, the section 6 and the second component 5 can also be separate components.

In the illustration, the terms "lower part" and "upper part" correspond to the preferred arrangement or orientation of the dispensing device 1 during normal use. This is not necessarily the case, however. Accordingly, depending on the need, application, design or the like, the lower part and the upper part can also be oriented spatially in any manner with respect to each other.

The section 6 is preferably elastically deformable. Especially preferably, an accommodation or pump chamber P is formed for the liquid 2 between the first component 4 and the other component or section 6 or is bordered thereby at least in part. Accordingly, the section 6 is connected with the first component 4—either directly or indirectly via the second component 5—preferably in a liquid-tight, particularly also gas-tight manner, for example adhered, welded or in another appropriate manner.

The dispensing device 1 is preferably embodied as a pump with an inlet valve 7 and an outlet valve 8.

Preferably, the section 6 forms the inlet valve 7 and/or the outlet valve 8 together with the first component 4. In principle, however, the valves 7, 8 can also be embodied separately. The valves 7, 8 are preferably embodied as self-closing one-way valves.

When the pump chamber P is filled with liquid 2, the volume of the pump chamber P can be reduced starting from the resting or initial position through deformation of the section 6, hence expelling and dispensing liquid 2 from the pump chamber P. Particularly, to this end, an optional actuating element 9 is moved manually in the direction of the arrow N, thus depressing at least a middle area or area to be actuated or actuation area 10 of the section 6.

Preferably, the actuating element 9 is associated with a preferably cap-shaped housing part 11 or is formed thereby. In the depicted example, the housing part 11 forms a preferably axially movable or tippable or depressable lever for actuating the dispensing device 1 or the pumped formed thereby.

However, it is also possible, for example, for a user or other object (not shown) to press directly on the section 6 or actuation section 10 to dispense liquid 2.

Upon depression or pumping, the liquid 2 is delivered or dispensed via the outlet valve 8. The opening of the outlet valve 8 preferably occurs automatically, preferably as a result of the pressure of the liquid, and/or—optionally in addition—as a result of a commensurate deformation of the section 6 upon depression.

In the depicted example, the outlet valve 8 is arranged laterally next to the area 10 or a preferably dome- or sphere-like area of the section 6.

The outlet valve 8 is preferably formed by a valve element, for example a flap-like one, which is particularly molded onto the second component 5 or the section 6 or is formed thereby.

The outlet valve 8 is connected to the pump chamber P via a connection channel 12. The opening of the outlet valve 8 occurs particularly automatically as a result of the pressure of the liquid. The liquid 2 can then flow out via an adjoining delivery channel 13 and/or a nozzle 14 or the like and be delivered.

In particular, the liquid 2 is delivered or sprayed or atomized from the nozzle 14 upon depression of the actuating element 9 or housing part 11. Alternatively or optionally, the delivery of liquid 2 can also occur through the dispensing device 1 in a non-atomized state.

Upon commensurate decrease in the pressure of the liquid in the pump chamber P—particularly after the depression of the section 6 or area 10 is completed—the outlet valve 8 closes again preferably automatically, particularly as a result of commensurate restorative forces.

After release, as a result of the inherent elasticity or restorative force of the area 10 or of the section 6, a preferably automatic return to the initial position shown in FIG. 1 occurs, with new liquid 2 being taken up, preferably sucked into the pump chamber P via the inlet valve 7. The opening of the inlet valve 7 during the return to position preferably occurs as a result of the negative pressure prevalent in the pump chamber P.

The inlet valve 7 preferably has a particularly tongue-like or leaf spring-like valve flap 15 which is molded onto the section 6 or the second component 5 which is pretensioned against the inlet opening 16 and particularly arranged in the pump chamber P.

During the return to position of the section 6 or area 10 from the depressed position (not shown) into the depicted initial position, liquid 2 is able to be taken up or sucked via a preferably provided connector 17 adjacent to the inlet valve 7 or the inlet opening 16 and particularly a suction line 18 adjacent thereto and extending into the container 3. Here, the inlet valve 7 or the valve flap 15 then opens, as indicated with a broken line in FIG. 1. After the sucking of liquid 2 into the pump chamber P, the inlet valve 7 or its valve flap 15 closes again preferably automatically.

In the first embodiment of the dispensing device 1 shown in FIG. 1, the thickness of the section 6 varies. In particular, the section 6 is thinner in an edge or transitional area 19—preferably at the transition to the first component 4, in an at least substantially cylindrical area and/or at a transition to the middle or raised area or area 10—which is to say it has a reduced wall thickness in comparison to the middle or actuation area 10. This allows for an easier deformation of the section 6 particularly in the transitional area 19 and hence an easier or simpler actuation of the dispensing device 1 or of the actuating element 9.

The area 10, the wall thickness of which is preferably reinforced, ensures a sufficiently good restorative behavior, particularly sufficient restorative forces. Alternatively or in addition to the increase in the wall thickness, the area 10 can also be provided with an appropriate reinforcement or the like (not shown).

The force for the deformation of the section 6—at least for the initial deformation—is preferably less than 50 N, particularly less than 30 N, very especially preferably less than 20 N. This allows for simple or easy actuation.

The force for the deformation of the section 6 preferably increases over the path of deformation—i.e. as the deformation increases. This allows for simple actuation that is particularly easy and intuitive at the beginning.

In the following, other aspects of the present invention are explained in further detail on the basis of a second embodiment of the dispensing device 1. Here, only substantial differences vis-à-vis the first embodiment are dealt with, so that the previous remarks apply particularly in a commensurate or complementary manner.

Figure 2:
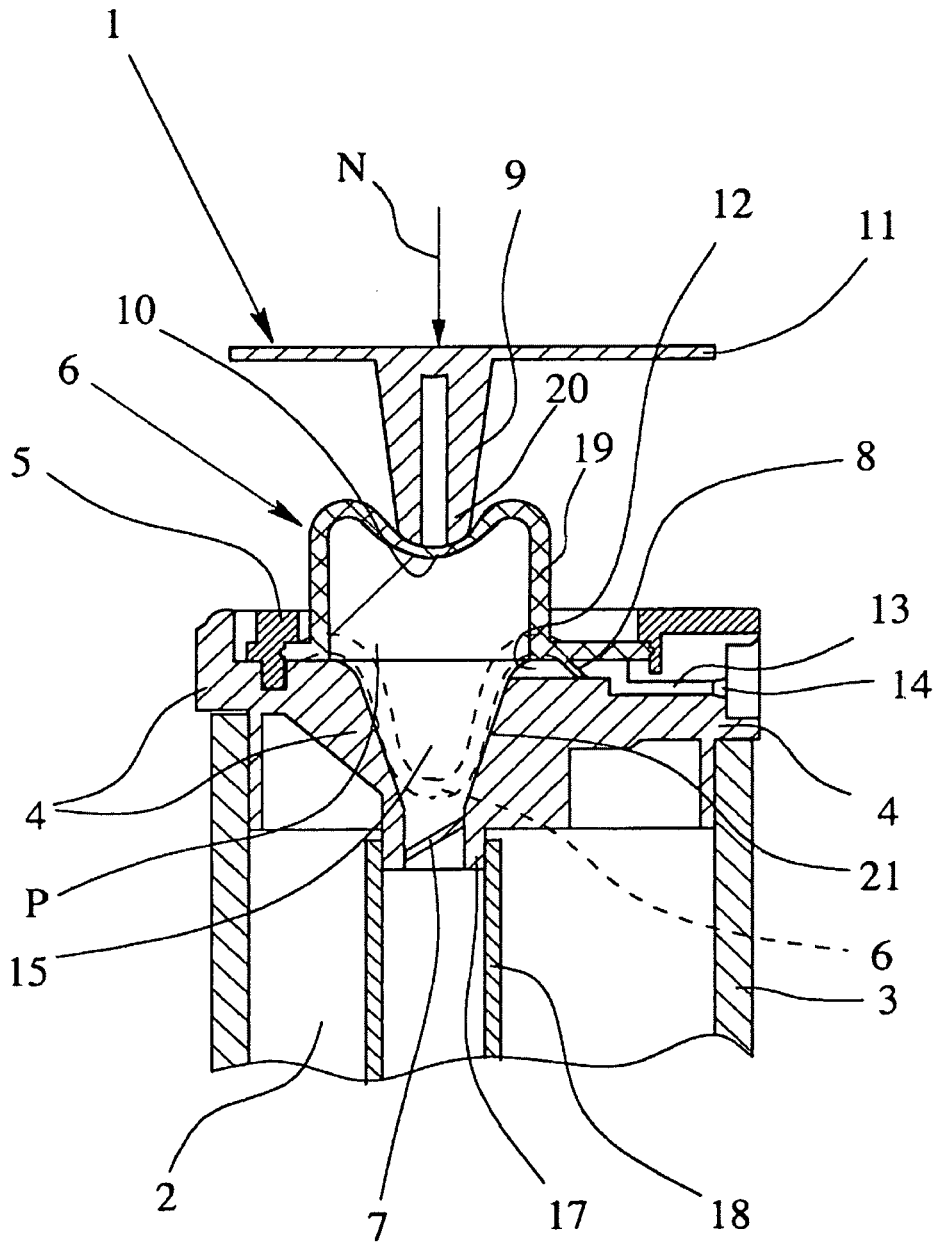
FIG. 2 shows a schematic section of a proposed dispensing device according to a second embodiment.

FIG. 2 shows the second embodiment in a schematic section corresponding to FIG. 1. The section 6 is also in the initial position, i.e. not in the deformed state.

The area 10 is preferably concave. Particularly, the area 10 is already concave in the initial position and/or in the unloaded state. This facilitates the initial actuation or reduces the initial actuating force. In particular, the concave area 10 is already preformed or shaped in the section 6.

The thickness of the section 6 also varies here. In contrast to the first embodiment, in the second embodiment the thickness is reduced particularly in the middle or area 10, optionally out to the edge or transitional area 19. This is conducive to a reduction of the force particularly for the initial deformation of the section 6.

Alternatively, however, the section 6 can also have a substantially uniform or constant wall thickness, at least in the areas which are deformable during actuation or for the dispensing of liquid.

In the second embodiment, the diameter of the actuating element 9—at least of the free end 20 of the actuating element 9 acting on the section 6 or actuation area 10—is preferably less than 50% of the diameter of the pump chamber P. This is conducive to an easy actuation or deformation, particularly at the beginning.

The end 20 of the actuating element 9 is preferably at least substantially flat or level or preferably only slightly spherical.

The actuating element 9 is preferably tapered toward the free end 20. In particular, the actuating element 9 is at least substantially uniform or tapered at a constant angle.

Especially preferably, the actuating element 9 has at least substantially the shape of a truncated cone or truncated pyramid out to the free end 20, which is particularly adjacent thereto in a continuous or rounded fashion.

The aforementioned design of the actuating element 9 is conducive to easy actuation, since the effective surface or displacement surface preferably increases slowly and, accordingly, the actuating force for the path or deformation or actuation increases only slowly. However, other constructive solutions are also possible for this purpose. Particular, the force curve also depends on the shape of the section 6 and of the other components which form or border on the pump chamber P and influence the deformation of the section 6.

Especially preferably, the actuating element 9 and the section 6 and/or the dispensing device 1 or the first component 4 are embodied such that, in the deformed state, the section 6 fills out the pump chamber P to greater than 70%, particularly to greater than 90%, especially preferably to greater than 95%. In this manner, an emptying of the pump chamber P which is at least substantially or largely complete upon commensurate actuation of the actuating element 9 or housing part 11. Accordingly, the dead volume in the pump chamber P is minimized. This in turn facilitates actuation since, particularly, an initial pumping or filling of the pump chamber P with liquid 2 (so-called "priming") is minimized or can be omitted to a great extent. The actuation is simplified and facilitated accordingly.

Especially preferably, the end 20 of the actuating element 9 acting on the section 6, and/or the actuating element 9 as a whole on the one hand and a bottom 21 of the pump chamber P or first component 4 arranged on the side facing away from the actuating element 9 on the other hand are designed to be at least substantially complementary to each other considering the wall thickness of the interposed section 6. Particularly, the bottom 21 forms a recess for this purpose into which the actuating element 9 is able to engage in the depressed state, which is not depicted in FIG. 2. In FIG. 2, the section 6 in the deformed or depressed state—i.e. with at least largely emptied pump chamber P—is merely represented with a broken line.

The aforementioned at least substantially complementary design is conducive to an at least substantially complete emptying of the pump chamber P when the section 6 is deformed or the actuating element 9 is depressed and simplifies actuation, as already explained.

In the second embodiment, the inlet valve 7 is arranged, for example, in the connection element 17 and/or recessed into the bottom 21.

Figure 3:
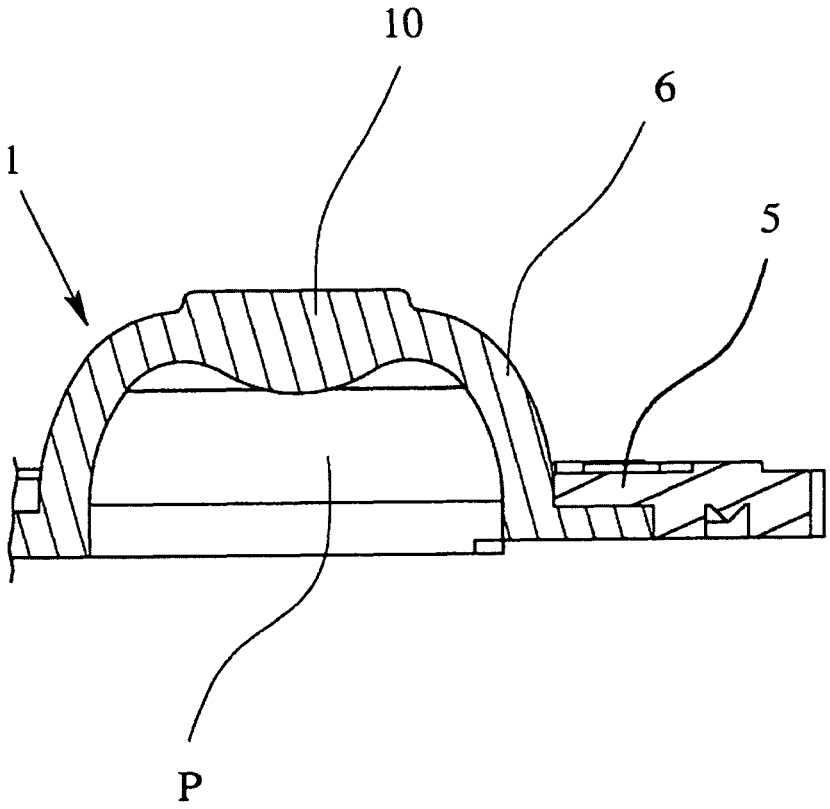
FIG. 3 shows a schematic section of a proposed dispensing device, particularly of its deformable section, according to a third embodiment.

FIG. 3 shows, in schematic section, the section 6 of the dispensing device 1 according to a third embodiment. For purposes of simplification, particularly the first component 4 and the actuating element 9 are not depicted. It should be noted that FIG. 3 shows the section 6 in the non-deformed, particularly unloaded state, i.e. state of manufacture.

In the third embodiment, the area 10 is preferably flat, particularly level, at least on its outer side.

According to an aspect of the present invention which can also be implemented independently as needed, the area 10 has a preferably larger wall thickness and/or rigidity than the adjacent wall of the section 6. The increase in rigidity can be achieved in a preferred manner by increasing the wall thickness and/or by embedding a material or stiffening element or through the formation of ribs or the like. The greater rigidity and/or flat design of the area 10 makes an optimized dispensing or pumping behavior possible. Particularly, during the initial actuation, a very quick and/or continuous pressure increase in the pump chamber P and/or a very uniform conveyance of the liquid 2 can be achieved.

Especially preferably, the wall thickness of the area 10 is enlarged at least in part in comparison to the remaining wall thickness of the section 6. In the depicted example, the wall thickness of the area 10 is particularly thickened toward the inside, as indicated by the inwardly arching inner wall of the area 10 in FIG. 3.

The wall of the section 6 adjoining the area 10 or enclosing same in a ring-like manner is designed in a preferably substantially arched, bonneted, spherical or convex manner, as indicated in FIG. 3.

Especially preferably, the section 6 is at least substantially hemispherical.

Individual aspects and features of the described embodiments can also be combined with each other at will and/or used in other dispensing devices, particularly manually operated pumps for cosmetic liquids or the like.

LIST OF REFERENCE SYMBOLS

1 dispensing device
2 liquid

3 container
4 first component
5 second component
6 section
7 inlet valve
8 outlet valve
9 actuating element
10 actuation section
11 housing part
12 connection channel
13 delivery channel
14 nozzle
15 valve flap
16 inlet opening
17 connector
18 suction line
19 transitional area
20 end
21 bottom
N direction of depression
P pump chamber

The invention claimed is:

1. A dispensing device for dispensing a liquid, comprising: a pump, with an elastically deformable or flexible, dome-like section which borders a pump chamber for the liquid or fluidically connected with the liquid, wherein the liquid can be pumped or conveyed by a reversible deformation of the section, and the liquid can be subsequently taken up via a sucking action, into the pump chamber by automatic returning of the section to an initial position, and an actuating element associated with a housing part acting on the section for the reversible deformation of the section from the initial position into a deformed state, wherein the section has a concave area in one or more of the initial position and in an unloaded state which can be pressed or deformed in order to pump the liquid into the pump chamber, wherein a thickness of the concave area of the dome-like section has a lesser wall thickness than a wall thickness of the dome-like section.

2. The dispensing device as set forth in claim 1, wherein a free end of the actuating element is flat or level or spherical.

3. The dispensing device as set forth in claim 1, wherein a diameter of the actuating element is less than 50% of a diameter of the pump chamber.

4. The dispensing device as set forth in claim 1, wherein the actuating element is tapered toward a free end.

5. The dispensing device as set forth in claim 4, wherein the actuating element is tapered uniformly, in the shape of a cone or truncated cone or truncated pyramid.

6. The dispensing device as set forth in claim 1, wherein one or more of: an end of the actuating element acting on the section and a bottom of the pump chamber arranged on a side facing away from the actuating element are complementary to each other, and the actuating element and the section are embodied such that the section fills out the pump chamber to greater than 90% in the deformed state.

7. The dispensing device as set forth in claim 1, wherein a force at least for an initial deformation of the section is less than 50 N.

8. The dispensing device of claim 1, wherein the liquid is a cosmetic liquid.

9. A dispensing device for dispensing a liquid comprising: a pump, with an elastically deformable or flexible, dome-like section which borders a pump chamber for the liquid or is fluidly connected with the liquid, wherein the liquid can be pumped or conveyed by a reversible deformation of the section, and the liquid can be subsequently taken up, via a sucking action, into the pump chamber by an automatic returning of the section to an initial position, and an actuating element associated with a housing part acting on the section for the reversible deformation of the section from the initial position into a deformed state, wherein the section has a flat or concave area in one or more of the initial position and in an unloaded state which can be pressed or deformed in order to pump the liquid into the pump chamber, wherein a pump bottom forms a recess into which the actuating element and the section are able to engage in the depressed state such that the section fills out the pump chamber to greater than 90%, and wherein a thickness of the flat or concave area has a lesser wall thickness than a wall thickness of the dome-like section.

10. The dispensing device as set forth in claim 9, wherein a free end of the actuating element is flat or level or spherical.

11. The dispensing device as set forth in claim 9, wherein a diameter of the actuating element is less than 50% of a diameter of the pump chamber.

12. The dispensing device as set forth in claim 9, wherein the actuating element is tapered toward a free end.

13. The dispensing device as set forth in claim 12, wherein the actuating element is tapered uniformly, in the shape of a cone or truncated cone or truncated pyramid.

14. The dispensing device as set forth in claim 9, wherein one or more of: an end of the actuating element acting on the section and a bottom of the pump chamber arranged on a side facing away from the actuating element are complementary to each other.

15. The dispensing device as set forth in claim 9, wherein a force at least for an initial deformation of the section is less than 50 N.

16. The dispensing device of claim 9, wherein the liquid is a cosmetic liquid.

17. A dispensing device for dispensing a liquid comprising: a pump, with an elastically deformable or flexible, dome-like section which borders a pump chamber for the liquid or is fluidly connected with the liquid, wherein the liquid can be pumped or conveyed by a reversible deformation of the section, and the liquid can be subsequently taken up, via a sucking action, into the pump chamber by an automatic returning of the section to an initial position and an actuating element associated with a housing part acting on the section for the reversible deformation of the section from the initial position into a deformed state, wherein a thickness of the dome-like section varies, such that the dome-like section has a greater wall thickness in a transitional area, wherein the transitional area is arranged in a middle of the section, wherein the transitional area is flat and level only on the outside, wherein the transitional area is thicker on the inside and has a greater wall thickness or ridgity than an adjoining wall of the section, and wherein the wall thickness of the transitional area is thickened toward where the transitional area is flat and level and toward the inside where there is an inwardly arching inner wall.

18. The dispensing device as set forth in claim 17, wherein the actuating element acts on or engages in the transitional area.

19. The dispensing device as set forth in claim 17, wherein the transitional area is preformed or molded in the section.

20. The dispensing device as set forth in claim 17, wherein the wall of the section adjoining the area or enclosing same in a ring-shaped configuration is arched, spherical, flatly spherical or convex.

* * * * *